US006516544B1

(12) United States Patent
Matisz et al.

(10) Patent No.: US 6,516,544 B1
(45) Date of Patent: Feb. 11, 2003

(54) SNOW PLOW HAVING AN IMPROVED ATTACHMENT MEANS AND AN ASSOCIATED METHOD

(75) Inventors: George Thomé Matisz, Pittsburgh, PA (US); Matthew Beale, Pittsburgh, PA (US); William D. Boehmer, Clairton, PA (US)

(73) Assignee: Solotec Corporation, Pittsburgh, PA (US)

( * ) Notice: Subject to any disclaimer, the term of this patent is extended or adjusted under 35 U.S.C. 154(b) by 0 days.

(21) Appl. No.: 08/741,964

(22) Filed: Oct. 31, 1996

(51) Int. Cl.[7] ..... E01H 5/04
(52) U.S. Cl. ..... 37/231; 37/232
(58) Field of Search ..... 37/231, 232, 233, 37/235, 241, 264, 266, 270, 272, 273, 279, 283; 172/811, 816, 817; 24/300, 301, 302, 16 PB, 16 R, 129 R, 17 AP, 265 AL, 265 CD, 265 R

(56) References Cited

U.S. PATENT DOCUMENTS 1,365,153 A * 1/1921 Clark ..... 37/232 X
1,920,475 A * 8/1933 Meyer ..... 37/231
1,964,617 A 6/1934 Bird
2,061,585 A 11/1936 Meyer
2,103,775 A * 12/1937 Frink ..... 37/232
2,103,900 A 12/1937 Gay
2,141,558 A 12/1938 Richter
2,188,805 A 1/1940 Borgeson
2,191,323 A 2/1940 Richter
2,234,645 A 3/1941 Hetzelt
2,350,437 A 6/1944 Wiedman
2,430,221 A 11/1947 Frink et al.
2,431,410 A 11/1947 Maxim
2,468,950 A 5/1949 Wiedman
2,575,091 A 11/1951 Borgeson (List continued on next page.)

OTHER PUBLICATIONS

"Clear Your Drive the Easy Way", *Popular Mechanics*, Dec. 1971.
Bush Hog—Blades & Scrapers, Jan. 1982.
Werts Corporation—Easy–Angle—High Lift (undated).

*Primary Examiner*—Victor Batson
(74) *Attorney, Agent, or Firm*—David V. RadAck; Eckert Seamans Cherin & Mellott, LLC

(57) ABSTRACT

A snow plow including a snow plow blade and snow plow strap to attach the snow plow blade to a vehicle. An associated method of attaching a snow plow blade to a vehicle is also provided.

14 Claims, 3 Drawing Sheets

U.S. PATENT DOCUMENTS

| | | | | | |
|---|---|---|---|---|---|
| 2,713,220 | A | * | 7/1955 | Muenchow | 37/232 X |
| 2,722,064 | A | * | 11/1955 | Jaffe et al. | 37/231 |
| 2,754,601 | A | | 7/1956 | Meyer | |
| 3,098,309 | A | | 7/1963 | Koch | |
| D201,451 | S | | 6/1965 | Graham | |
| 3,302,958 | A | * | 2/1967 | Fawcett et al. | 37/231 X |
| 3,316,665 | A | | 5/1967 | Rinaldo | |
| 3,349,507 | A | | 10/1967 | Payne | |
| 3,524,269 | A | | 8/1970 | Jackoboice | |
| 3,575,251 | A | | 4/1971 | Moore | |
| 3,883,965 | A | * | 5/1975 | Poirier, Sr. et al. | 37/232 |
| 4,024,653 | A | * | 5/1977 | Morris | 37/231 |
| 4,049,229 | A | * | 9/1977 | Peisner | 24/265 CD X |
| 4,058,173 | A | | 11/1977 | Carson | |
| 4,096,977 | A | * | 6/1978 | Barville et al. | 24/265 AL |
| 4,255,884 | A | | 3/1981 | Williams | |
| 4,561,153 | A | * | 12/1985 | Matsui | 24/16 PB |
| 4,574,502 | A | | 3/1986 | Blau | |
| 4,658,519 | A | | 4/1987 | Quenzi | |
| 4,718,587 | A | | 1/1988 | Roberts | |
| 4,731,942 | A | | 3/1988 | Eberle | |
| 4,833,799 | A | | 5/1989 | Harte | |
| 4,873,775 | A | | 10/1989 | Richey | |
| 4,944,104 | A | | 7/1990 | Kowalczyk | |
| 5,048,207 | A | | 9/1991 | Verseef | |
| 5,063,695 | A | | 11/1991 | Briscoe et al. | |
| 5,088,215 | A | | 2/1992 | Ciula | |
| 5,207,010 | A | | 5/1993 | Grossman | |
| 5,251,390 | A | | 10/1993 | Wong | |
| 5,309,653 | A | | 5/1994 | Pease et al. | |
| 5,477,600 | A | | 12/1995 | Houle et al. | |
| 5,509,219 | A | * | 4/1996 | Mecca | 37/231 |
| D377,653 | S | * | 1/1997 | Matisz et al. | D15/11 |
| 5,638,617 | A | * | 6/1997 | Belanger et al. | 37/232 X |
| 5,673,464 | A | * | 10/1997 | Whittaker | 24/301 |

* cited by examiner

SNOW PLOW HAVING AN IMPROVED ATTACHMENT MEANS AND AN ASSOCIATED METHOD

BACKGROUND OF THE INVENTION

This invention relates to a snow plow having an improved attachment means and an associated method, and more particularly, to a lightweight, portable snow plow that can be easily and effectively attached to a vehicle in order to use the vehicle and the snow plow to plow snow.

There are several known ways of removing snow from driveways, roads and parking lots, each of which have significant shortcomings. The first (1) is by manually using a snow shovel. This is a time-consuming, potentially hazardous and labor intensive activity. Furthermore, many persons, whether because of physical handicaps or infirmities, such as heart trouble, are not able to shovel snow or do so at their peril. The second way (2) is by using electric or gas powered snow removal equipment, such as a snow-blower. Although functional, snow-blowers typically cost several hundred dollars and have all of the problems associated with powered equipment, such as the need for maintenance, the possibility of breakdown just when the equipment is needed or is being used, and the real potential risk of injury to the user if improperly used.

The third method (3) is a vehicular mounted snow plow. These snow plows are mounted to the vehicle (usually a pick-up truck or sport utility vehicle) by a mechanical mounting device that sometimes includes an hydraulic mechanism for raising and lowering the blade. These snow plows are usually made of metal, and are very heavy and somewhat difficult to mount. These snow plows are normally sold and serviced by a dealer network. Furthermore, these snow plows typically are not feasible for the home owner who only occasionally needs to plow the driveway in order to gain access to street surfaces. For these reasons, vehicle-mounted snow plows are usually owned by commercial snow removal operators.

There have been suggested snow plows which are mounted to a vehicle without the use of expensive and intricate hydraulic equipment. For example, U.S. Pat. No. 4,944,104 discloses securing the snow plow to the car by means of suction cups mounted on horizontal arms. The suction cups engage primarily against the hood of the vehicle. U.S. Pat. No. 4,833,799 discloses a lightweight synthetic resin snow plow which is connected to the tow rings of a vehicle.

Commonly owned U. S. patent application Ser. No. 08/484,175 filed Jun. 7, 1995 discloses a lightweight, portable snow plow having bumper columns which contact the bumper of a vehicle so that the vehicle can push the snow plow in order to plow snow. However, there is no disclosure of an attachment means for attaching the plow to the vehicle.

Despite the existence of these inventions, there is still needed a portable, lightweight snow plow that can be easily and effectively attached to a vehicle for subsequent use in plowing snow.

SUMMARY OF THE INVENTION

The invention has met or exceeded the above-mentioned needs, as well as others. The snow plow of the invention includes a snow plow blade and a snow plow strap. The snow plow strap attaches the snow plow blade to a vehicle. In one embodiment, vehicle ring connectors are secured to the vehicle and complementary snow plow ring connectors, which have the snow plow strap threaded therethrough, are attached to the vehicle ring connectors by squeezing the snow plow ring connectors and passing them through the vehicle ring connectors. Subsequent expansion of the snow plow ring connectors after passage through the vehicle ring connectors attaches them together, thus attaching the snow plow strap and snow plow blade to the vehicle.

In another embodiment, a vehicle attachment strap is secured to a vehicle with vehicle attachment strap ring connectors being threaded therethrough. The snow plow ring connectors are then secured to the vehicle attachment strap ring connectors as was discussed above. The vehicle attachment strap can be secured to the vehicle by (i) looping it through bumper gaps formed by the bumper and the vehicle body; (ii) looping it around the top portion of a bumper and the undersurface of the chassis of the vehicle; or (iii) providing crevice anchors that are wedged into wheel well cover gaps formed by the side panel and the wheel well cover of the vehicle.

An associated method of attaching the snow plow blade to the vehicle is also provided wherein a portion of the snow plow strap is attached to the snow plow blade and another portion of the snow plow strap is attached to the vehicle.

BRIEF DESCRIPTION OF THE DRAWINGS

A full understanding of the invention can be gained from the following description of the preferred embodiment when read in conjunction with the accompanying drawings in which.

DETAILED DESCRIPTION

Figure 1:
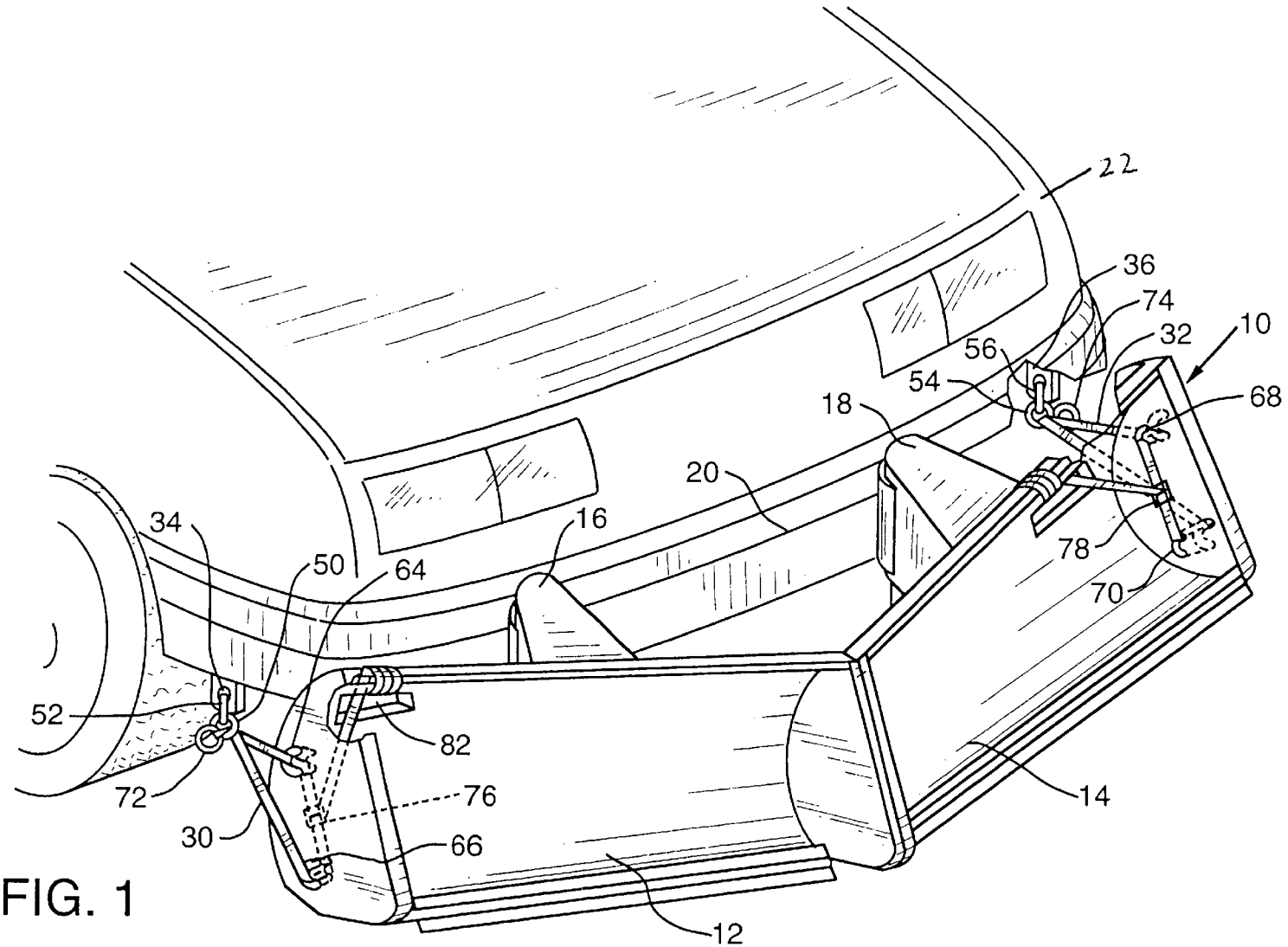
FIG. 1 is a perspective view of the snow plow of the invention showing one embodiment of the attachment means of the invention.

Referring to FIG. 1, the snow plow and associated attachment means will be discussed. The snow plow 10 preferably consists of two blade wing sections 12 and 14 joined at the center by securing means (not shown). Each blade wing section 12 and 14 has an integrally formed bumper column 16 and 18, respectively, which is adapted to contact the bumper 20 of a vehicle 22. The blade wing sections 12 and 14 are preferably formed as integral units and are made of a lightweight material, such as a plastic, for example, polyethylene. The snow plow is preferably "portable" which, as used herein, means that it can be carried by a human being having normal strength. Preferably, the entire snow plow 10 weighs between about thirty and fifty pounds.

The blade wing sections 12 and 14 are preferably made by a rotational molding process known to those skilled in the art. For a more detailed description of the snow plow, reference is made to commonly owned U.S. patent application Ser. No. 08/484,175, filed Jun. 7, 1995, the disclosure of which is incorporated by reference herein.

Figure 2:
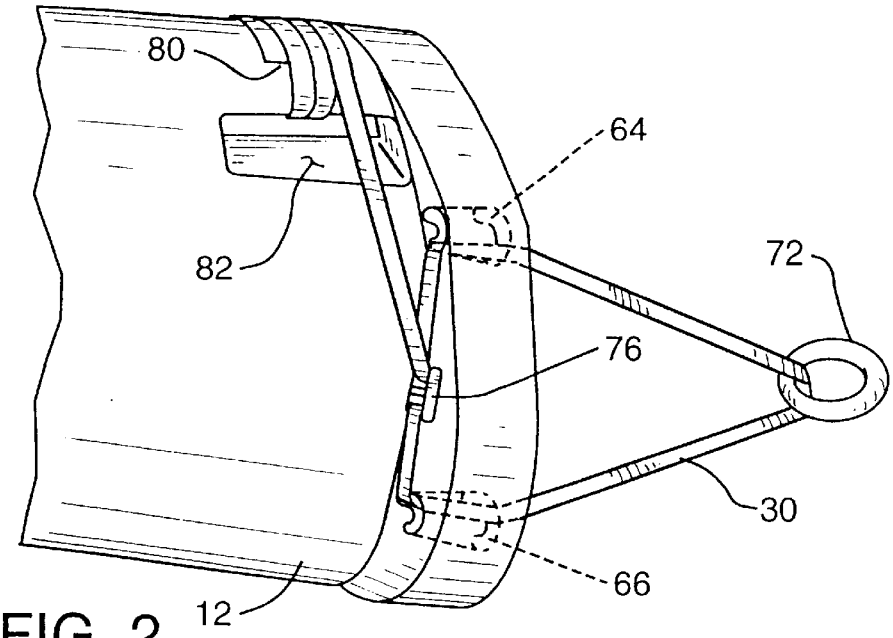
FIG. 2 is a detailed perspective view of the back of one of the wing sections of the snow plow blade showing the attachment of the snow plow strap to the snow plow blade.

Referring now to FIGS. 1–3, one embodiment of the attachment means of the invention is shown. In this embodiment a pair of snow plow straps 30 and 32 are used to attach the snow plow 10 to the vehicle 22. More particularly, the embodiment shown in FIGS. 1–3 is useful when the vehicle 22 has a pair of tow rings 34 and 36 attached to the undersurface of the vehicle 22. These tow rings 34 and 36 are commonly found on vehicles imported from overseas to the United States.

Figure 3A:
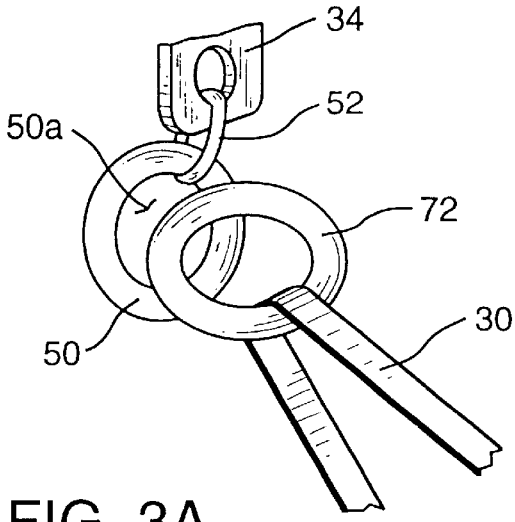
FIGS. 3A–3C show how the snow plow ring connector is attached to the vehicle ring connector.
Figure 3B:
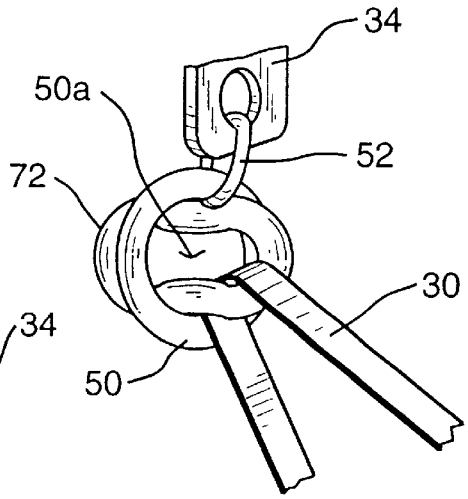
Figure 3C:
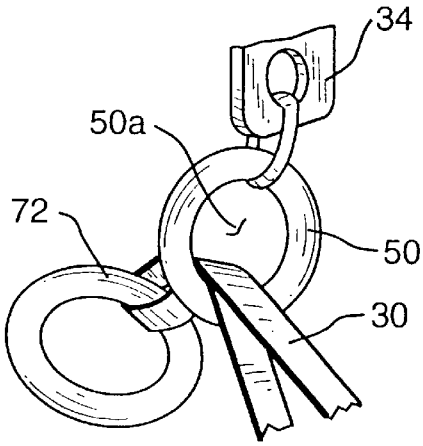

As can best be seen in FIGS. 1 and 3A–3B, a first resilient O-ring 50 is secured to tow ring 34 by a cable tie 52. A second resilient O-ring 54 is also secured to tow ring 36 by a cable tie 56 (see FIG. 1). It will be appreciated that the O-rings 50 and 54 can be secured to the tow rings 34 and 36 by other means, such as permanent adhesives or the like, however, the cable ties 52 and 56 are the preferred method. It will be further appreciated that the O-rings 50 and 54 can be secured to any suitable portion of the vehicle 22, not necessarily the tow rings 34 and 36. For example, the O-rings 50 and 54 could be secured by means of cable ties to a slot in the undersurface of the chassis or to a projection from the undersurface of the chassis.

Once the O-rings 50 and 54 are secured to the vehicle 22, the snow plow 10 can then be attached thereto. As can be seen in FIGS. 1 and 2, the preferred embodiment is a pair of snow plow straps 30 and 32 which are threaded through a pair of respective slots (i) 64 and 66 on blade wing section 12 and (ii) 68 and 70 on blade wing section 14. The snow plow straps 30 and 32 also are threaded through the center of respective resilient snow plow ring connectors 72 and 74. The snow plow straps 30 and 32 each form closed loops which prevent the snow plow strap ring connectors 72 and 74 from becoming unthreaded therefrom. The closed loops are formed by using a cam lock means 76 and 78 for each strap 30 and 32. Referring to FIG. 2, the cam lock means 76 for strap 30 is shown in detail. The cam lock means 76 is permanently attached to one end of the strap 30 and the free end portion 80 of the strap 30 is threaded through the cam lock means 76 and pulled tightly to form the closed loop. The excess strap section is preferably wrapped around the hand hole 82 which is integrally formed into the blade wing section 12. It will be appreciated that strap 32 is secured to the blade wing section 14 similarly to the way strap 30 is secured to the blade wing section 12.

Once the snow plow straps 30 and 32 are secured to the blade wing sections 12 and 14, the snow plow strap connectors 72 and 74 can be attached to the vehicle attached O-rings 50 and 52. Referring to FIGS. 3A–3B, the snow plow ring connector 72 is first moved towards the opening 50a defined by the O-ring 50 (FIG. 3A) and then snow plow ring connector 72 is squeezed by the user and passed through the opening 50a (FIG. 3B). Once the snow plow ring connector 72 is passed through the opening 50*a*, it expands to its previous shape (FIG. 3C) and thus attaches to the O-ring 50, thus attaching the snow plow strap 30 and wing section 12 to the vehicle 22. A similar procedure is used to attach snow plow ring connector 74 to O-ring 52.

It will be appreciated that the invention provides a quick, easy and effective way of attaching a snow plow to a vehicle. Another advantage of the invention is that the connected rings also act as disconnect device. For example, once the snow plow is connected to the vehicle 22 by means of the rings, should the snow plow 10 hit a bump or pothole on a user's driveway and thus get stuck, the snow plow ring connector 72 is resilient enough to pull through the opening 50a in the O-ring 50 and thus unattach the snow plow 10 from the vehicle 22. In this way, the O-ring/snow plow ring connector attachment is a "weak point" that will give when necessary. We have found that the O-ring/snow plow ring connector attachment can withstand about fifty pounds of pulling force without becoming unattached. This is a preferred amount of force, as an attachment which can withstand more than this force will likely cause damage to the vehicle whereas an attachment which becomes unattached at less than this amount of force will cause user inconvenience in the potential of having to reattach the snow plow 10 to the vehicle 22 for relatively minor shocks caused by irregularities in the driveway surface to be plowed.

Figure 4:
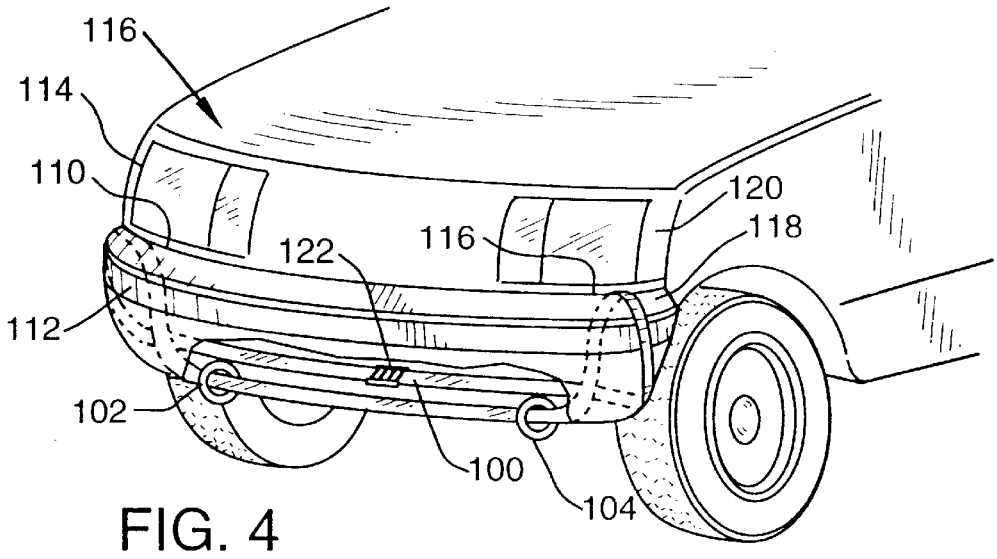
FIG. 4 is a perspective view, partially cutaway, showing an alternate method of the attachment means, particularly, providing a vehicle attachment strap which is threaded through the bumper gaps of the vehicle.
Figure 5:
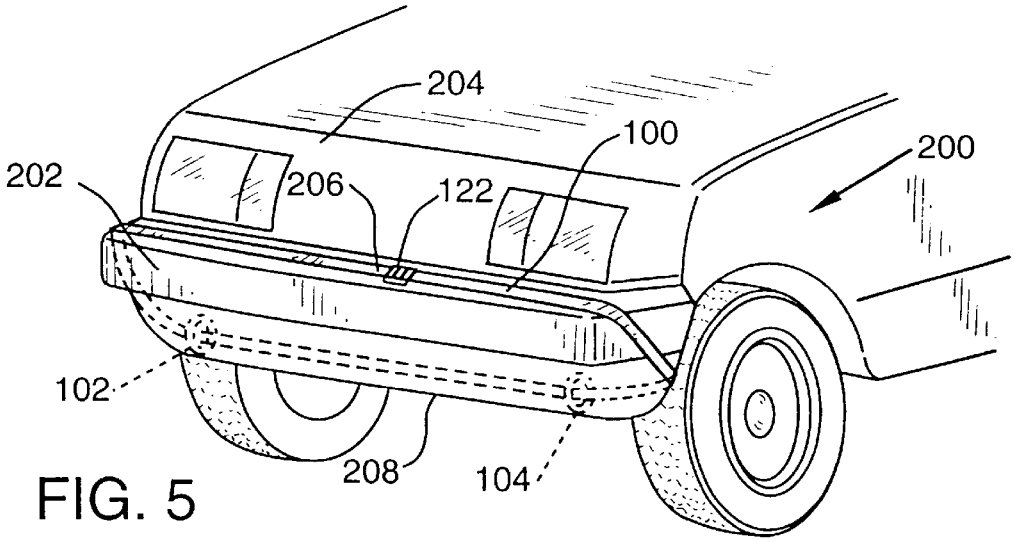
FIG. 5 is a perspective view showing yet another embodiment of the attachment means, particularly, providing a vehicle attachment strap which is wrapped around the top portion and undersurface of the bumper of the vehicle.
Figure 6:
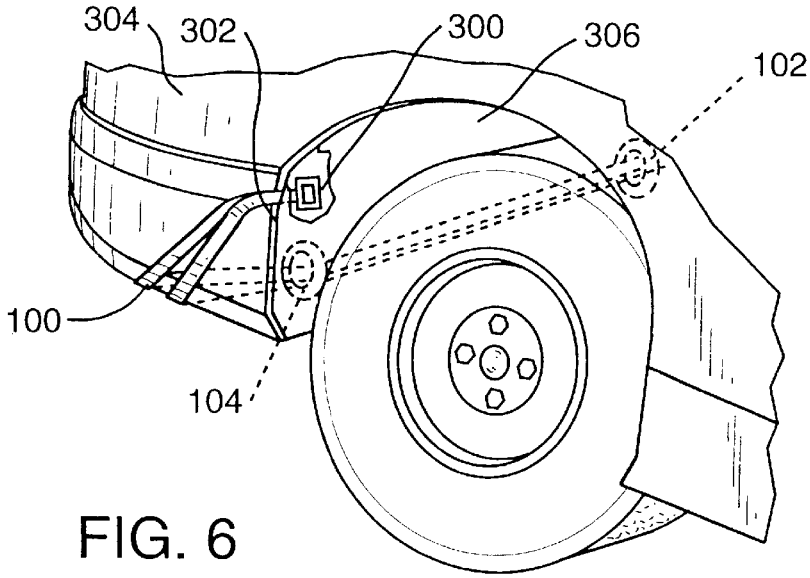
FIG. 6 is a perspective view of still another embodiment of the attachment means, particularly, providing a pair of crevice anchors which are placed in wheel well gaps formed by the side panels and wheel well covers of the vehicle.

Referring now to FIGS. 4–6, there is shown three embodiments for providing O-rings to use for the O-ring/snow plow ring connector attachment where it is not possible or desirable to attach the O-rings directly to the structure of the vehicle 22. In all three embodiments a vehicle attachment strap 100 is threaded through a pair of O-rings 102 and 104, which then can be used to attach the snow plow strap ring connectors 72 and 74 thereto as was described above. In FIG. 4, the vehicle attachment strap 100 is threaded through first opening 110 formed by the left bumper portion 112 and the left front 114 of the vehicle 116 and then threaded through a second opening 116 formed by the right bumper portion 118 and the right front 120 of the vehicle 116.

As discussed above, the vehicle attachment strap 100 is threaded through the O-rings 102 and 104. The vehicle attachment strap 100 includes a cam lock means 122 permanently attached to one end thereof and a free end portion 124 which is threaded through the cam lock means 122 and pulled tightly to form a closed loop to hold the O-rings 102 and 104 in place. The closed loop is secured to the bumper of the vehicle 116.

Once the O-rings 102 and 104 are in position, snow plow ring connectors 72 and 74 can be attached thereto as was described above with reference to FIGS. 3A–3C.

Referring to FIG. 5, if the vehicle, such as vehicle 200, does not have a space between the bumper 202 and vehicle body 204, the vehicle attachment strap 100 can be wrapped around the top portion 206 of the bumper 202 and the undersurface 208 of the bumper 202 to again form a loop (by means of employing the cam lock means 122 as was discussed above). Again, the loop holds the O-rings 102 and 104 in place for subsequent attachment of the snow plow ring connectors 72 and 74 thereto. The loop is secured to the bumper 202.

FIG. 6 shows yet another embodiment of using the vehicle attachment strap 100. In this embodiment, crevice anchors, only one of which, crevice anchor 300 is shown in FIG. 6, are attached to the vehicle strap 100. These crevice anchors 300 are designed to be inserted into a wheel well gap 302 formed by the side panel 304 and the wheel well cover 306 of the vehicle 310. Preferably, the crevice anchor 300 is constructed and arranged so that it can be (i) inserted into the wheel well gap 302 and then (ii) manipulated, such as by rotating it, so that it remains secured in the wheel well gap 302, such as by a portion of the crevice anchor 300 engaging against the side panel 304 and an another portion of the crevice anchor engaging against the wheel well cover 306, thus, in effect, wedging the crevice anchor 300 into the wheel well gap 302. It will be appreciated that in this embodiment, as can be seen in FIG. 6, the vehicle attachment strap 100 is threaded through each of the O-rings 102 and 104.

The method of the invention involves attaching a snow plow blade to a vehicle by providing a snow plow strap, attaching a portion of the snow plow strap to the snow plow blade and attaching another portion of the snow plow strap to the vehicle. It will be appreciated that although two snow plow straps 30 and 32 are shown in the Figures, the invention also encompasses providing a single snow plow strap that can be attached to a single attachment point on the vehicle.

It will be appreciated that a snow plow having an improved attachment means and an associated method has been disclosed. The snow plow is easy to attach to a vehicle and is easy to use to plow snow from driveways and avoids the labor-intensive snow removal method of hand shovelling as well as the expense and danger of using power-driven snow removal equipment.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A snow plow that is attached to a vehicle, said snow plow comprising:

a snow plow blade;

a vehicle attachment strap adapted to be secured to said vehicle;

a first vehicle attachment strap ring connector through which said vehicle attachment strap is threaded;

a second vehicle attachment strap ring connector through which said vehicle attachment strap is threaded;

a first snow plow ring connector made of a resilient material;

a second snow plow ring connector made of a resilient material;

a first snow plow strap secured to said snow plow blade and being threaded through said first snow plow ring connector to secure said first snow plow ring connector to said first snow plow strap;

a second snow plow strap secured to said snow plow blade and being threaded through said second snow plow ring connector to secure said second snow plow ring connector to said second snow plow strap; and said snow plow being attached to said vehicle by squeezing each of said first and second snow plow ring connectors and passing them through said first and second vehicle ring connectors, respectively, whereby subsequent expansion of said first and second snow plow ring connectors after passage through said first and second vehicle ring connectors attaches said first and second snow plow straps and said snow plow blade to said vehicle.

2. The snow plow of claim 1, wherein said vehicle includes a vehicle body and a bumper, said vehicle body and said bumper defining a pair of space enclosed bumper gaps therebetween;

said vehicle attachment strap has a pair of ends, one of said ends including a cam lock means;

said vehicle attachment strap is adapted to be threaded through said bumper gaps and joined at said ends to form a closed loop that is secured to said bumper.

3. The snow plow of claim 1, wherein said vehicle includes a protruding bumper having a top portion and an undersurface;

said vehicle strap has a pair of ends, one of said ends including a cam lock means;

said vehicle attachment strap is adapted to be joined at said ends to form a closed loop, said closed loop being adapted to be wrapped around said top portion and said undersurface of said bumper to secured said closed loop to said bumper.

4. The snow plow of claim 1, wherein said vehicle includes a first and second front wheel cover and a first and second side panel, said first wheel cover and said first side panel forming a first wheel well gap and said second wheel cover and said second side panel forming a second wheel well gap;

said vehicle attachment strap has a pair of ends, one of said ends including cam lock means;

a first crevice anchor secured to one end of said vehicle attachment strap;

a second crevice anchor secured to the other end of said vehicle attachment strap;

said vehicle attachment strap is joined at said ends by means of said cam lock means to form a closed loop; and said first crevice anchor is placed through said first wheel well gap and is positioned so that a portion of the first crevice anchor engages against said first wheel cover and another portion of said first crevice anchor engages against said first side panel so that said first crevice anchor is wedged in said first wheel well gap; and said second crevice anchor is placed through said second wheel well gap and is positioned so that a portion of said second crevice anchor engages against said second wheel cover and another portion of said second crevice anchor engages against said second side panel so that said second crevice anchor is wedged into said second wheel well gap.

5. The snow plow of claim 1, wherein said snow plow blade includes a first wing section having first and second slots defined therein and a second wing section having third and fourth slots defined therein;

said first snow plow strap is threaded through said first and second slots, said first snow plow strap forming a first closed loop; and said second snow plow strap is threaded through said third and fourth slots, said second snow plow strap forming a second closed loop.

6. The snow plow of claim 1, wherein said snow plow blade is made of plastic.

7. A snow plow that is attached to a vehicle, said snow plow comprising:

a snow plow blade;

a first vehicle ring connector adapted to be secured to said vehicle;

a second vehicle ring connector adapted to be secured to said vehicle;

a first snow plow ring connector made of a resilient material;

a second snow plow ring connector made of a resilient material;

a first snow plow strap secured to said snow plow blade and being threaded through said first snow plow ring connector to secure said first snow plow ring connector to said first snow plow strap;

a second snow plow strap secured to said snow plow blade and being threaded through said second snow plow ring connector to secure said second snow plow ring connector to said first snow plow strap; and said snow plow blade being releasably attached to said vehicle by squeezing each of said first and second snow plow ring connectors and passing them through said first and second vehicle ring connectors whereby subsequent expansion of said first and second snow plow ring connectors after passage through said first and second vehicle ring connectors attaches said first and second snow plow straps and said snow plow blade to said vehicle.

8. The snow plow of claim 7, wherein said snow plow blade is made of plastic.

9. A snow plow that is attached to a vehicle, said snow plow comprising:

a snow plow blade;

a first vehicle ring connector adapted to be secured to said vehicle;

a second vehicle ring connector adapted to be secured to said vehicle;

a first snow plow ring connector made of a resilient material;

a second snow plow ring connector made of a resilient material;

a first snow plow strap secured to said snow plow blade and being threaded through said first snow plow ring connector to secure said first snow plow ring connector to said first snow plow strap;

a second snow plow strap secured to said snow plow blade and being threaded through said second snow plow ring connector to secure said second snow plow ring connector to said first snow plow strap;

said snow plow blade being attached to said vehicle by squeezing each of said first and second snow plow ring connectors and passing them through said first and second vehicle ring connectors, respectively, whereby subsequent expansion of said first and second snow plow ring connectors after passage through said first and second vehicle ring connectors attaches said first and second snow plow straps and said snow plow blade to said vehicle;

said snow plow blade includes a first wing section having first and second slots defined therein and a second wing section having third and fourth slots defined therein;

said first snow plow strap threaded through said first and second slots, said first snow plow strap forming a first closed loop; and said second snow plow strap threaded through said third and fourth slots, said second snow plow strap forming a second closed loop.

10. The snow plow of claim 9, wherein said first snow plow strap includes cam lock means for use in forming said first closed loop; and said second snow plow strap includes cam lock means for use in forming said second closed loop.

11. A snow plow that can be attached to a vehicle, said snow plow comprising:

a snow plow blade; and releasable attache means for releasably attaching said snow plow blade to said vehicle, whereby said snow plow blade can disattach from said vehicle when an undesired pulling force is encountered in order to avoid damage to said vehicle;

said releasable attachment means including a snow plow strap, a snow plow ring connector through which said snow plow strap is threaded and a vehicle ring connector to attach said snow plow strap to said vehicle, said snow plow ring connector being attached to said vehicle ring connector;

wherein said snow plow ring connector is made of a resilient material and is attached to said vehicle ring connector by squeezing said snow plow ring connector and passing it through said vehicle ring connector, whereby subsequent expansion of said snow plow ring connector after passage through said vehicle ring connector attaches said snow plow ring connector to said vehicle ring connector.

12. A snow plow that can be attached to a vehicle, said snow plow comprising:

a snow plow blade;

a snow plow strap to attach said snow plow blade to said vehicle;

a vehicle ring connector to attach said snow plow strap to said vehicle;

a snow plow ring connector through which said snow plow strap is threaded, said snow plow ring connector being attached to said vehicle ring connector;

said snow plow ring connector is made of a resilient material and is attached to said vehicle ring connector by squeezing said snow plow ring connector and passing it through said vehicle ring connector, whereby subsequent expansion of said snow plow ring connector after passage through said vehicle ring connector attaches said snow plow ring connector to said vehicle ring connector;

said snow plow blade includes at least one slot; and said snow plow strap is looped through said slot and said vehicle ring connector to attach said snow plow blade to said vehicle.

13. A snow plow that is attached to a vehicle, said snow plow comprising:

a snow plow blade;

a first vehicle ring connector adapted to be secured to said vehicle;

a second vehicle ring connector adapted to be secured to said vehicle;

a first snow plow ring connector made of a resilient material;

a second snow plow ring connector made of a resilient material;

a first snow plow strap secured to said snow plow blade and being threaded through said first snow plow ring connector to secure said first snow plow ring connector to said first snow plow strap;

a second snow plow strap secured to said snow plow blade and being threaded through said second snow plow ring connector to secure said second snow plow ring connector to said first snow plow strap;

said snow plow blade being attached to said vehicle by squeezing each of said first and second snow plow ring connectors and passing them through said first and second vehicle ring connectors, respectively, whereby subsequent expansion of said first and second snow plow ring connectors after passage through said first and second vehicle ring connectors attaches said first and second snow plow straps and said snow plow blade to said vehicle;

said vehicle includes a first tow ring and a second tow ring spaced from said first tow ring;

a first cable tie adapted to secure said first vehicle ring connector to said first tow ring; and a second cable tie adapted to secure said second vehicle ring connector to said second tow ring.

14. A method of attaching a snow plow blade to a vehicle comprising:

providing a snow plow strap:

attaching a portion of said snow plow strap to said snow plow blade;

attaching another portion of said snow plow strap to said vehicle;

providing a vehicle ring connector secured to said vehicle;

attaching said snow plow strap to said vehicle ring connector in order to attach said snow plow strap to said vehicle;

providing a snow plow ring connector through which said snow plow strap is threaded;

attaching said snow plow strap ring connector to said vehicle ring connector in order to attach said snow plow strap to said vehicle;

said snow plow ring connector is made of a resilient material; and attaching said snow plow ring connector to said vehicle ring connector by squeezing said snow plow ring connector and passing it through said vehicle ring connector, whereby subsequent expansion of said snow plow ring connector after passage through said vehicle ring connector attaches said snow plow ring connector to said vehicle ring connector.

* * * * *

UNITED STATES PATENT AND TRADEMARK OFFICE

CERTIFICATE OF CORRECTION

PATENT NO. : 6,516,544 B1 
DATED : October 31, 1996
INVENTOR(S) : George Thomé Matisz et al.

It is certified that error appears in the above-identified patent and that said Letters Patent is hereby corrected as shown below:

Column 6,
Line 12, "secured" should read -- secure --.

Column 7,
Line 12, insert -- ,respectively, -- after "connectors".
Line 15, insert -- releasably -- after "connectors".

Signed and Sealed this

Fifteenth Day of April, 2003

JAMES E. ROGAN
*Director of the United States Patent and Trademark Office*